United States Patent [19]

Plesinger et al.

[11] Patent Number: 4,665,822

[45] Date of Patent: May 19, 1987

[54] SQUEEGEE FOR SCREEN PROCESS PRINTERS FOR PRINTING OF DIELECTRIC AND METALLIC PASTES FOR SINGLE AND MULTILAYER HYBRID CIRCUITS

[75] Inventors: Boris Plesinger, Scottsdale; Lynn H. Brown, Phoenix, both of Ariz.

[73] Assignee: Honeywell Information Systems Inc., Phoenix, Ariz.

[21] Appl. No.: 861,806

[22] Filed: May 12, 1986

[51] Int. Cl.[4] ..... B41L 13/18

[52] U.S. Cl. ..... 101/123

[58] Field of Search ..... 101/114, 115, 116, 119, 101/120, 123, 124

[56] References Cited

U.S. PATENT DOCUMENTS

| | | | |
|---|---|---|---|
| 2,109,336 | 2/1938 | Marsden | 101/119 X |
| 3,735,730 | 5/1973 | Mitter | 101/119 X |
| 3,930,445 | 1/1976 | Jaffa | 101/123 X |
| 4,051,777 | 10/1977 | Black et al. | 101/123 |
| 4,080,893 | 3/1978 | Wedell | 101/123 X |
| 4,299,164 | 11/1981 | Jonkers | 101/119 X |

FOREIGN PATENT DOCUMENTS

| | | | |
|---|---|---|---|
| 270751 | 8/1970 | U.S.S.R. | 101/119 |

*Primary Examiner*—Edgar S. Burr

*Assistant Examiner*—Moshe I. Cohen

*Attorney, Agent, or Firm*—A. A. Sapelli; J. S. Solakian; A. Medved

[57] ABSTRACT

A squeegee is utilized in a screen process printer for microcircuits and components thereof. The type is one in which the squeegee and a flat stationary screen are mounted with the squeegee movable and in a wiping action makes contact with the screen so as to press a paste through openings of the screen in a predetermined pattern onto an adjacent substrate. The squeegee comprises a cylindrically shaped object of a predetermined length having a surface covering made of a resiliently deformable material. Further, the squeegee has an external cross-sectional geometric pattern such that a first surface is pushed against the paste in the wiping action. A lower edge of the first surface is above the surface of the screen a predetermined distance, and the first surface is at a predetermined fixed angle with the screen thereby causing a spreading action of the paste on the screen surface. The geometric pattern further has a second surface whereby a lower edge of the second surface is in pressure contact with the screen, and further wherein the angle of the second surface to the screen is less than the angle of the first surface to the screen, thereby providing a high hydraulic pressure forcing the paste into the screen openings.

5 Claims, 3 Drawing Figures

SQUEEGEE FOR SCREEN PROCESS PRINTERS FOR PRINTING OF DIELECTRIC AND METALLIC PASTES FOR SINGLE AND MULTILAYER HYBRID CIRCUITS

BACKGROUND OF THE INVENTION

This invention relates to screen process printers of microcircuits, and more particularly, to a squeegee comprising an essential part of the screen process printing apparatus.

A form of screen printing which is widely used today, particularly in the production of microelectronic circuitry is known as "thick film" printing. In general, most of the screen printers in use are flat bed devices with a horizontal work carrier in squeegee travel attitudes. Usually, the screen is fixed, while the squeegee assembly moves in respect thereto. The circuit or portion of a circuit or layer of dielectric is printed on a substrate which is usually in the form of a flat wafer. The components of the circuit are printed on the wafer by using a slurry, which is often called ink or paste, the paste being a dielectric paste or a metallic paste. A microelectronic pattern is created by forcing the paste through a screen containing the same pattern of open mesh in the screen and which covers the substrate material. This is often accomplished by first applying the paste over the screen and then moving a blade, usually known as a "squeegee", over the screen so that the squeegee pushes the paste forward and hydraulically forces the paste into the pattern opening of the screen so that the paste passes onto the substrate. Thus, the paste in the pattern opening has been sheared from the paste on the top of the screen by the blade, and the screen upon retracting leaves the image paste on the top of the substrate because the paste has greater affinity for the substrate than for the screen. The result is the deposition of an image, i.e., a layer of printed material approximately the thickness of the screen. If the miniaturized circuit is to function properly, parameters of the circuit must be within acceptable limits. This means that the size of the thickness of the printed component must be within predictably narrow limits and since the circuitry is highly miniaturized, the tolerances are miniscule.

The squeegee pressure on the screen and substrate and the uniformity of the pressure is vital to the formation of acceptable limits. Too little pressure will prevent proper seals between the squeegee and the screen and between the screen and the substrate which are necessary for precision printing. Present systems include various ways for maintaining the force between the squeegee and the printing screens, for example, biasing the squeegee towards the screen by means of a coil spring, or utilizing a torsion bar and link to exert a moment on the link and thus force the squeegee to urge the squeegee against the printing screen, as described in U.S. Pat. No. 3,924,529, entitled "Torsion Bar Floating Squeegee Mount for Screen Printer".

In existing systems, the squeegee has taken a variety of forms. For example, a flat squeegee stock has been employed, and is disposed in a position of inclination with respect to the plane of the screen, so as to apply only a corner of the stock to the screen. Or, in another flat form, the edge is beveled with the squeegee being disposed in a plane perpendicular to the plane of the screen. In every instance, the squeegee is intended to present a comparatively even, sharp edge to the screen, and to define an angle of 45° to 60° between the leading surface of the squeegee and the screen, thus to push a roll of paste ahead of the squeegee while at the same time creating a pressure upon the paste forcing it through the screen (reference U.S. Pat. No. 3,438,819).

The present invention provides for a novel cross-sectional configuration of the squeegee which increases the pressure of the blade against the screen, especially desired in today's "fine-line" technology where line widths are in the 1-mil range, thereby creating more reliable printing of the paste onto the substrate.

SUMMARY OF THE INVENTION

Therefore, there is provided by the present invention a novel configuration of a squeegee. In a screen process printer for microcircuits and components thereof, of the type in which a squeegee and a flat stationary screen are mounted with the squeegee movable, and in a wiping action makes contact with the screen so as to press a paste through openings of the screen in a predetermined pattern onto an adjacent substrate. The squeegee comprises a shaft-like object of a predetermined length having a surface covering made of a resiliently deformable material. Further, the squeegee has an external cross-sectional geometric pattern such that a first surface is pushed against the paste in the wiping action. A lower edge of the first surface is above the surface of the screen a predetermined distance, and the first surface is at a predetermined fixed angle with the screen thereby causing a spreading action of the paste on the screen surface. The geometric pattern further has a second surface whereby a lower edge of the second surface is in pressure contact with the screen and further wherein the angle of the second surface to the screen is less than the angle of the first surface to the screen, thereby providing a high hydraulic pressure forcing the paste into the screen openings.

Accordingly, it is an object of the present invention to provide a novel configuration for a squeegee.

It is another object of the present invention to provide a novel configuration of a squeegee which increases the pressure of the squeegee against the screen.

It is still another object of the present invention to provide a novel configuration of a squeegee which increases the pressure of the squeegee against the screen causing the paste to be forced through the screen openings more reliably, with increased pressure against the paste.

It is still a further object of the present invention to provide a novel configuration of a squeegee which increases the pressure of the squeegee against the screen thereby causing the paste to be forced through the screen openings with greater pressure resulting in more reliable printing of the paste against the substrate.

These and other objects of the present invention will become more apparent when taken in conjunction with the following description and attached drawings, wherein like characters indicate like parts, and which drawings form a part of the present application.

DETAILED DESCRIPTION

Figure 1:
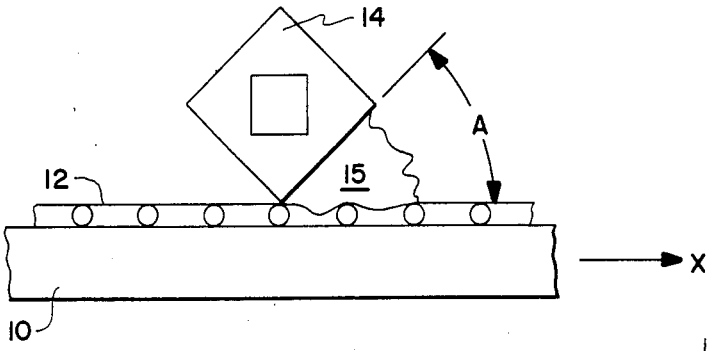
Fig. 1 PRIOR ART
FIG. 1 shows a side-view of a prior art squeegee in operation, in conjunction with a screen and substrate.

Referring to FIG. 1, there is shown a side-view of a prior art configuration of a squeegee in operation, in conjunction with a screen and substrate. A substrate 10 has a screen 12 placed against the surface of the substrate 10 upon which an image contained in the screen 12 is to be printed. A squeegee 14, having a square cross-section is positioned such that an edge is in pressure contact against the screen 12 and where an angle of attack, A, i.e., the angle between the leading surface of the squeegee 14 and the screen 12, is 45°. The squeegee has a length, L (not shown). A quantity of a thick film paste 15 (or more simply referred to as paste), the paste being either metallic or dielectric material, had been placed on the screen and has a volume, V. The squeegee 14 moves in the X direction at a velocity, v, such that the squeegee 14 maintains the orientation as shown in the FIG. 1, and further wherein the corner, T, is in pressure contact against the screen 12. The hydraulic pressure, P, of the paste 15 between the squeegee 14 and the screen 12 is represented by the relationship (1) where the hydraulic pressure, p, is proportional to the volume of the paste 15 (V), the velocity of the squeegee 14 (v), the viscosity of the paste 15 ($\mu$), and inversely proportional to the angle of attack (A):

$$p \; \alpha \mu v \sqrt{\frac{V}{(\text{Sine } A)^2}} \qquad (1)$$

Figure 2:
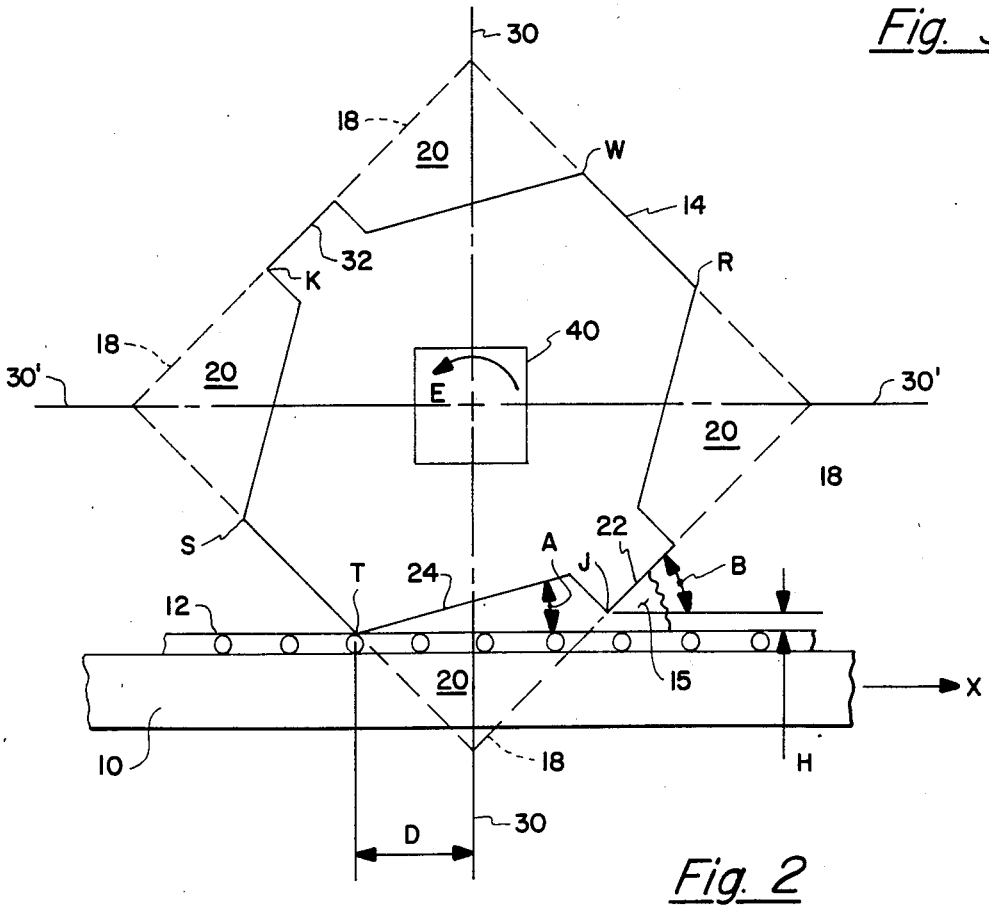
FIG. 2 shows a side-view of the squeegee of the present invention.

Referring to FIG. 2, there is shown a side-view of the squeegee of the present invention which takes advantage of the relationship (1) defined above, in addition to providing other advantages which will be described hereinunder. The squeegee 14 of the present invention has a cross-sectional area essentially as shown in the side view of FIG. 2. Within the basic square shape (shown by the dotted lines 18), there are cut-outs (or cavities) of trapezoidal shape 20 which modify the basic square shape. In the "wiping" configuration, surface 22 of the squeegee 14, which is also part of the basic square shape 18, forms an angle B with respect to the screen 12, in the preferred embodiment of the present invention angle B being approximately a 45° angle with the surface of the screen 12. Point J of the squeegee 14 is a predetermined distance H above the surface of the screen 12. The angle B provides initial pressure against the paste 15 for spreading the screen 12 with a predetermined volume of paste 15 given by gap H. The angle of attack A, formed by surface 24 of the squeegee 14, and with point T in pressure contact against the surface of the screen 12, provides the increased hydraulic pressure needed for reliable printing of the "fine-lines". In the preferred embodiment of the present invention, the angle A is approximately 15°. In conjunction with the relationship (1) described above, since the angle of attack A is smaller in the present invention, it can be seen that the pressure, p, is increased. Yet another advantage of the present invention is the contact point T between the squeegee 14 and the screen 12 is located behind the squeegee vertical axis 30 a distance D. This arrangement prevents any intermittent disengagement between the squeegee 14 and the screen 12, a phenomenon sometimes referred to as chatter. The arrangement of the present invention causes a dragging action, as the squeegee 14 is moved in the direction X at a velocity, v, parallel to the surface of the screen 12.

A reverse wiping action is achieved by rotating the squeegee 14 90° around the point of intersection of the axes 30 and 30' in the E direction (i.e., counter-clockwise) so that point S is now in pressure contact with the screen 12, and point K and surface 32 form the initial spreading action. Points W and R, respectively, can likewise be used for the printing of the paste 15 onto the substrate 10 corresponding to the printing action of points T and S, respectively. This arrangement therefore provides four "blades" similar to that of the prior art arrangement in addition to providing the additional features described above.

The squeegee 14 is made of a resiliently deformable material, and it will be noted at this point that the material may vary as desired. Commonly, in the art, neoprene or polyurethane hve been employed. While these materials have certain disadvantages, and may in the future give way to improved materials, they are satisfactory for present purposes and either may be employed in carrying out the present invention. It is believed that in future constructions, it may even be possible to employ stainless steel, which of course would be dimensionally accurate, would be of completely rigid construction, and would hold any predetermined angle. This may be coated with a plastic or synthetic material having a predetermined yieldability to provide a cushioning action as a preventive against undue wear of the screen. In the preferred embodiment of the present invention, a structural shaft 40 is included to mount and rotate the squeegee 14.

Figure 3:
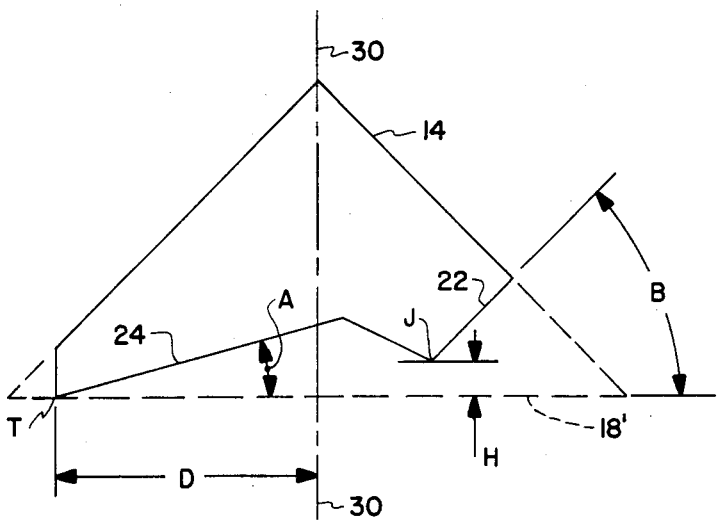
FIG. 3 shows an alternative embodiment side-view of a squeegee which falls within the spirit and scope of the present invention.

Referring to FIG. 3, there is shown an alternate embodiment side-view of a squeegee which incorporates the concepts of the present invention disclosed herein. The angle of attack A, formed by second surface 24 of the squeegee 14 is less than the angle of attack B of the first surface 22. Point J is a predetermined distance H above the surface of the screen (not shown) and point T of the second surface 24 is in pressure contact against the screen (not shown). Also, point T is behind the vertical axis 30 a distance, D, the vertical axis 30 being the line through which a downward force is applied to squeegee 14.

While there has been shown what is considered the preferred embodiment of the present invention, it will be manifest that many changes and modifications can be made therein without departing from the essential spirit and scope of the invention. It is intended, therefore, in the annexed claims to cover all such changes and modifications which fall within the true scope of the invention.

What is claimed is:

1. In a screen process printer for microcircuits and components thereof, of the type in which a squeegee and a flat stationary screen are mounted with the squeegee movable and in a wiping action makes contact with the screen so as to press a paste through openings of the screen in a predetermined pattern onto an adjacent substrate, whereby said squeegee comprises:

a shaft having a square-shaped cross section of a predetermined length having a surface covering made of a resiliently deformable material, and further having an external cross-sectional pattern in the form of a square with the four corners of the square, each corner having an area of trapezoidal shape removed to form cut-outs at the corners.

2. In a screen process printer for microcircuits and components thereof, of the type in which a squeegee and a flat stationary screen are mounted with the squeegee movable and in a wiping action makes contact with the screen so as to press a paste through openings of the screen in a predetermined pattern onto an adjacent substrate, whereby said squeegee comprises:

a shaft having a square-shaped cross section of a predetermined length having a surface covering made of a resiliently deformable material, and further having an external cross-sectional pattern in the form of a square with the four corners of the square, each corner having an area of trapezoidal shape removed to form cut-outs at the corners, such that the opposite sides of the squeegee which form part of the square are equal and adjacent sides of the squeegee which form part of square are unequal.

3. In a screen process printer for microcircuits and components thereof, of the type in which a squeegee and a flat stationary screen are mounted with the squeegee movable and in a wiping action makes contact with the screen so as to press a paste through openings of the screen in a predetermined pattern onto an adjacent substrate, whereby said squeegee comprises:

a shaft having a square-shaped cross section of a predetermined length having a surface covering made of a resiliently deformable material, and further having an external cross-sectional pattern in the form of a square with the four corners of the square, each corner having an area of trapezoidal shape removed to form cut-outs at the corners, such that the opposite sides of the squeegee which form part of the square are equal an adjacent sides of the squeegee which form part of the square are unequal, thereby in the wiping action a first surface being in contact with the paste, the first surface being formed in part by the side which forms part of the square and has a lower edge of the surface above the surface of the screen to form a gap, the first surface providing a spreading action of the paste, and a second surface being in contact with the spreaded paste, the second surface formed in part by a side of the cut-out, the second surface having a lower angle of attack than said first surface, thereby providing a high hydraulic pressure forcing the paste into the screen openings.

4. In a screen process printer for microcircuits and components thereof, of the type in which a squeegee and a flat stationary screen are mounted with the squeegee movable and in a wiping action makes contact with the screen so as to press a paste through openings of the screen in a predetermined pattern onto an adjacent substrate, whereby said squeegee comprises:

a shaft having a square-shaped cross section of a predetermined length having a surface covering made of a resiliently deformable material, and further having an external cross-sectional geometric pattern such that a first surface is pushed against the paste in the wiping action, a lower edge of the first surface being above the surface of the screen a predetermined distance, and said first surface is at a predetermined fixed angle with said screen thereby causing a spreading action of the paste on the screen surface, and the geometric pattern further having a second surface whereby a lower edge of the second surface is in pressure contact with the screen, and further wherein the angle of the second surface to the screen is less than the angle of the first surface to the screen.

5. In a screen process printer for microcircuits and components thereof, a squeegee according to claim 4, further comprising:

the point of contact of the lower edge of the second surface and the screen being behind the axis of the geometric pattern.

* * * * *